US005431545A

United States Patent [19]

Knight et al.

[11] Patent Number: 5,431,545

[45] Date of Patent: Jul. 11, 1995

[54] PUMPER SYSTEM FOR IN-SITU PIGGING APPLICATIONS

[75] Inventors: Larry F. Knight, Seabrook; Bobby N. Chaffin, Damon; Ronald W. DeLorme, Magnolia, all of Tex.

[73] Assignee: Praxair Technology, Inc., Danbury, Conn.

[21] Appl. No.: 161,112

[22] Filed: Dec. 2, 1993

[51] Int. Cl.[6] ..... F04B 25/00

[52] U.S. Cl. ..... 417/248; 417/253

[58] Field of Search ..... 417/62, 244, 248, 253

[56] References Cited

U.S. PATENT DOCUMENTS

| | | | |
|---|---|---|---|
| 2,218,565 | 10/1940 | Vickers | 417/62 |
| 2,366,388 | 1/1945 | Crosby | 417/62 |
| 2,599,701 | 6/1952 | Eames | 417/62 |
| 3,244,106 | 4/1966 | Guy . | |
| 3,496,960 | 2/1970 | Hughes | 417/62 |
| 4,474,539 | 10/1984 | Wolf | 417/62 |
| 5,042,521 | 8/1991 | Shiomi | 417/62 |

*Primary Examiner*—Richard A. Bertsch
*Assistant Examiner*—Peter Korytnyk
*Attorney, Agent, or Firm*—Alvin H. Fritschler

[57] ABSTRACT

A pumper system is adapted to enable pumps to be switched between parallel operation, for the high flow conditions normally desired for in-situ pigging operations within a line to be cleaned, and series operation, for the high pressure conditions needed in the event the pigging device becomes obstructed in the line.

9 Claims, 1 Drawing Sheet

PUMPER SYSTEM FOR IN-SITU PIGGING APPLICATIONS

BACKGROUND OF THE INVENTION

1. Field of the Invention

The invention relates to the passage of hydraulic pigging systems through pipelines and other conduits. More particularly, it relates to a water pumper facilitating the movement of pig devices through such lines.

2. Description of the Prior Art

Pigging systems are commonly employed in order to clean or condition the inside surfaces of pipelines or other conduits. In normal pigging operations, a high flow of a propelling fluid is required at moderate pressure levels. During movement of the pig device through a line, however, the resistance to travel occasionally increases. Such increased resistance may be due to a variety of factors. During cleaning operations, the most common cause is the encountering of the pig with a thicker deposit on the wall of the line. This resistance to travel causes the pig to slow down or even to stop in the line. The propelling pressure then required to move the stuck pig forward, even at a slower rate, can be several times higher than the normal pressure required to move the pig before it became stuck in the line.

Centrifugal pumps commonly used to propel a pigging system through a line are capable of delivering high water or other liquid flow at a moderate pressure level, typically on the order of 300 psi. If higher pressures are required when using the typical centrifugal pump approach, identical pumps are commonly employed in series in order to achieve the desired higher flow pressure. For example, two centrifugal pumps of 300 psi capacity would be connected for series flow to get a 600 psi pressure level, three such pumps would be piped in series to obtain a 900 psi pressure, and the like. Higher flow rates would be accomplished with a larger impeller unit or by adding additional pumps in parallel. Operating in this manner, the pump system is sized for the maximum flow rate desired, and additional stages are added in series to achieve the maximum pressure desired for a particular operating circumstance.

Such practice of sizing a pumping system to deliver both the maximum required flow and the maximum required pressure results in a larger, and hence more expensive, pumping system than would be required for either the maximum flow or the maximum pressure alone. The use of a larger pump also requires the use of a more powerful driver and associated higher capital and operating costs.

There is a genuine desire in the art, therefore, for improved pumpers for the passage of pigging systems through lines. More particularly, it is desired to enable pigging operations to be carried out using less expensive pumping equipment capable of conveniently satisfying the unique problems encountered in pigging operations.

It is an object of the invention to provide a water or other fluid pumper suitable for use with hydraulic pigging systems.

It is another object of the invention to provide a water or other fluid pumper system capable of advantageous use in propelling a pigging device through a line and overcoming resistance to travel of said device.

With these and other object in mind, the invention is hereinafter described in detail, the novel features of the invention being particularly pointed out in the appended claims.

SUMMARY OF THE INVENTION

A pumper system is employed that enables pumps to run either in parallel or in series in pigging operations. By enabling two pumps to run in parallel, the requirements for high flow in pigging operations can be achieved. By switching the same two pumps to series operation, the high pressure required to move a pig device that becomes stalled in a line is achieved at a moderate but acceptable flow rate.

BRIEF DESCRIPTION OF THE DRAWINGS

The invention is hereinafter described in detail with reference to the accompanying drawings in which.

DETAILED DESCRIPTION OF THE INVENTION

The objects of the invention are accomplished employing a dual pump system that is capable of operating in series or in parallel to meet the unique requirements of pigging operations. By enabling switching of pumps between high flow and high pressure conditions as needed, the pumper system of the invention enables smaller, less expensive pumps to be advantageously employed in pigging operations.

It should be noted that, in the field of fire fighting trucks, centrifugal water pumps have been designed with two stages that can be operated in parallel for extremely high flow at 300 psi, or in series for lower flow at 600 psi. In addition, an optional third stage can be employed to boost the pressure from the first two pumping stages to 800 psi, for long range fire fighting requirements. The pump is designed with the outlets from the third stage completely independent form the first two stages. Such a pumper, with one outlet for high flow and a second one for high pressure, while advantageous for fire fighting purposes, would be impractical for efficient pigging operations.

In the practice of the invention, the supply of fluid for the third stage is supplied by the discharge of the first two pump stages. A single discharge pumper of the invention ties the discharge from the third stage into the discharge of the first two stages downstream of the supply line to the third stage, with a check valve being employed in between to prevent recirculation through the third stage. This configuration is uniquely different from that used on prior art hydraulic pigging pumpers for fire truck applications. Thus, the pumper system of the invention can be run with the supply valve to the third stage open, and the unit will supply high flow rates at low pressure. If the pig becomes stuck, the third stage will kick in to supply additional pressure. In such embodiments, the invention automatically provides the pressure capability that would normally require the use of a positive displacement pump, while still providing the high flow capacities desired at lower pressures.

The invention involves modification of conventional pumper systems to enable automatic switching from high flow rate, moderate pressure operation to high pressure conditions when the need is encountered upon a pig device becoming stuck in a line. In one embodiment of the invention, a switchable parallel-series pump system is adapted for use in pigging operations. The system has two, or more, identically sized pumps, which are piped to allow operation of the pumps in parallel for normal pigging operations. When a restriction is encountered in the line being treated, the operation of the pumps is switched to series flow in order to provide higher pressure, moderate flow conditions until the resistance to pig flow is overcome.

Figure 1:
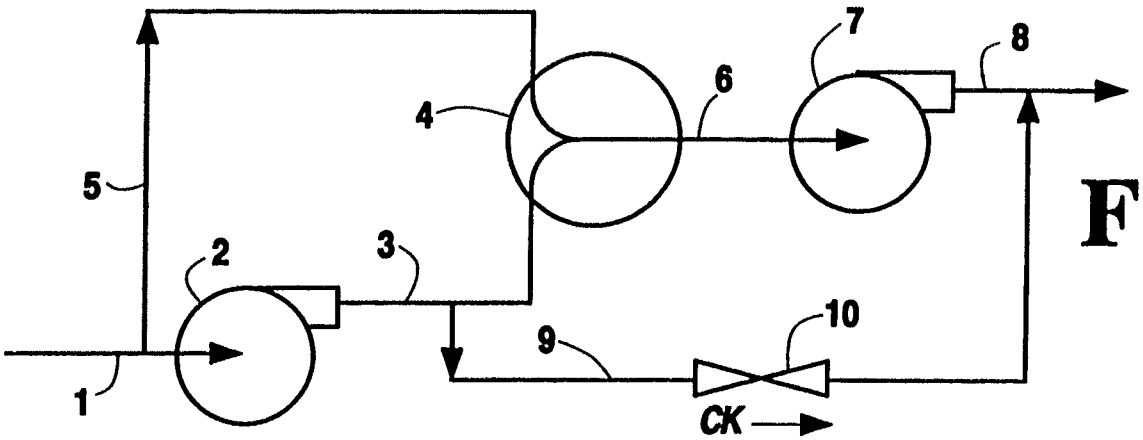
FIG. 1 is a schematic flow diagram of an embodiment of the pumper of the invention.

In FIG. 1 of the drawing, feed inlet line 1 is connected to pump 2, the discharge of which is passed, in line 3 to two-way valve 4, with the suction of pump 2 likewise being passed in by-pass line 5, to said two-way valve 4. Fluid from two-way valve 4 is passed in outlet line 6 to pump 7 from which fluid is discharged in outlet line 8 for passage to the pipeline or other conduit being treated by the passage of a pig device therefrom under the propelling force of the water or other fluid passing from the illustrated two pump system. By-pass line 9 containing check valve 10 extends from line 3 to outlet line 8.

In the operation of the FIG. 1 embodiment, two-way valve 4 switches the suction of pump 7 from the discharge of pump 2 in line 3 to the suction of pump 2 in line 5. This switches the two pumps from parallel operation to series operation. In said parallel operation, pump 2 suction in by-pass line 5 passes to pump 7, and pump 2 discharge passes in by-pass line 9 to join pump 7 discharge in outlet line 8. In said series operation, the discharge in line 3 from pump 2 passes to the suction of pump 7 in line 6. In parallel flow operation, check valve 10 allows the discharge in by-pass line 9 from pump 2 to flow to the discharge from pump 7 in outlet line 8. In series flow operation, check valve 10 precludes the back-flow passage of gas in by-pass line 9, while the discharge from pump 2 passes in line 3 to two-way valve 4 and to line 6 for series flow passage to pump 7.

For the pigging operations to which the invention is directed, the pumper normally operates in the parallel mode. If a restriction is encountered by a pig device in the line being treated, so that higher pressure operation is required, two-way valve 4 is moved from its parallel mode position to its series mode position so that a high pressure, lower flow rate operation pertains, to facilitate the overcoming of the restriction to flow in the line being treated. Check valve 10 precludes the back-flow of fluid in by-pass line 9 from outlet line 8 to line 3. When the restriction has been overcome, two-way valve 4 is switched back to its position for parallel flow operation, and normal pigging operations are continued on a high flow rate, moderate pressure basis.

Figure 2:
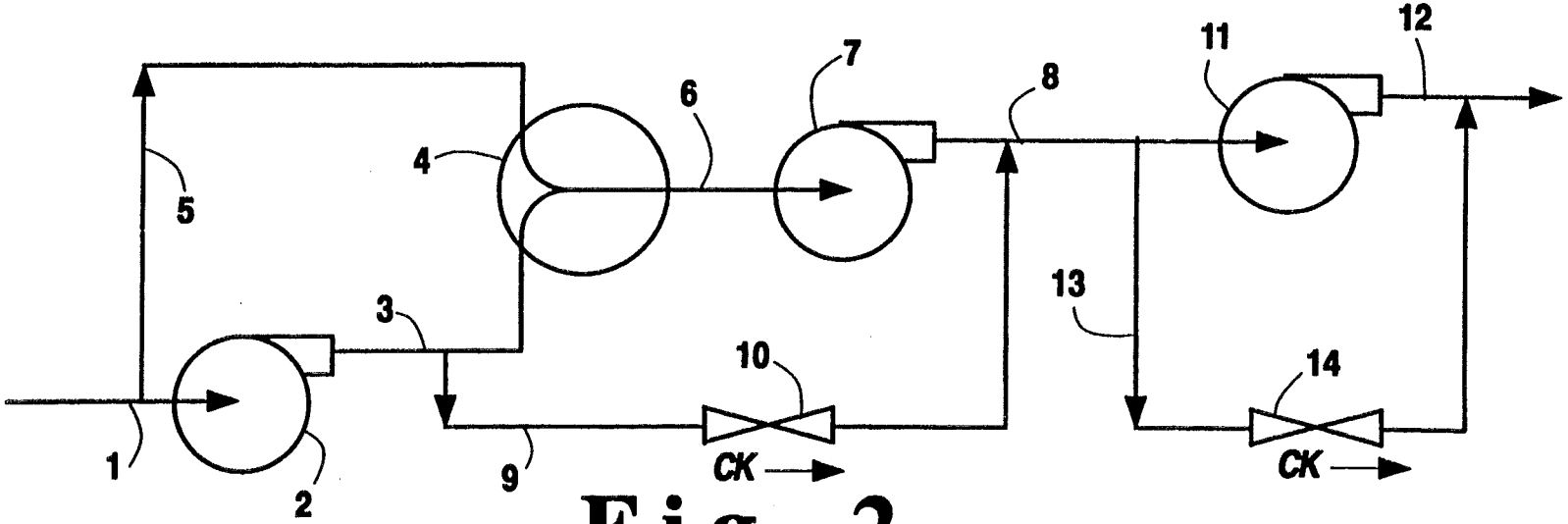
FIG. 2 is a schematic flow diagram of an alternative embodiment of the invention adapted to provide additional flow pressure to overcome an obstacle to the flow of a pig device in a line.

If the two pumps in series are not capable of providing sufficient pressure to overcome an obstacle to pig movement in a line, a boost pump left engaged and piped, as shown in FIG. 2 of the drawings, will automatically provide even high pressure at lower flow rates. In this embodiment, the elements common to those as shown in FIG. 1 pertain and operate as described above. Accordingly, the numerals designating said common elements are the same in FIG. 2 as in FIG. 1. Outlet line 8 in the FIG. 2 embodiment is passed, however, to boost pump 11 from which discharge fluid is passed in outlet line 12 for use as a propelling fluid to facilitate passage of a pigging device through a pipeline or other conduit being cleaned or otherwise treated. By-pass line 13, containing check valve 14, extends from line 8, downstream of by-pass line 9, to outlet line 12, i.e., from the suction to the discharge of boost pump 11.

When the required pressure of the pumper system does not provide sufficient pressure to overcome an obstacle to the movement of a pig in a line, boost pump 11 engaged and piped as shown in FIG. 2 will automatically provide even high flow pressures at lower flow rates. When the necessary operating pressure is below the maximum pressure of the two pumps, i.e, pumps 2 and 7, operating in series, check valve 14 in by-pass line 13 allows the flow of fluid to by-pass boost pump 11. When the pressure required for downstream pigging operations exceeds the capabilities of the two pumps, check valve 14 will close, due to the downstream pressure in outlet line 12 being higher than the upstream pressure in line 8, so that all of the fluid flow will be through boost pump 11 rather than through by-pass line 13. In this manner, the additional pressure required to overcome an obstacle to pig flow can be conveniently provided, so that the desired cleaning or conditioning of a line can be continued.

Those skilled in the art will appreciate that various changes and modifications can be made in the details of the invention as herein described without departing from the scope of the invention as recited in the appended claims. While use of a two-way control valve as described illustrated in the drawings, is a conventional item readily available for commercial use, and is a preferred element for use in the practice of the invention, the function served by this valve, i.e., two way control valve 4, can be accomplished by other readily available means. Thus, individual valves could be piped together and operated to serve the same purpose of controlling the flow of fluid to or around pump 7 for series or parallel operation.

Such valves can be of any basic type commercially available in the field. Said two-way control valve, or said individual valves, can be manually operated, remotely activated, or automatically activated by a suitable process computer/controller system.

It will be appreciated that the propelling fluid for the pigging purposes of the invention is conveniently water, but that pigging operations using other propelling fluids can also be employed using the pumper system of the invention. Said two-way control valve, or said individual valves, can be manually operated, remotely activated, or automatically actuated by a suitable commercially available process computer/controller system. Those skilled in the art will also appreciate the any suitable, commercially available fluid pumper units, conveniently centrifugal pumps, can be used in the practice of the invention. As indicated above, such pumps having an operating pressure level of about 300 psi are particularly suitable for the pigging purposes of the invention, although other capacity pumps can also be employed depending on the pumping capacity required for a particular pigging operation. Likewise, the fluid flow rate requirements of the pumping units employed will also depend on the particular operating conditions applicable to a given pigging operation, e.g., the size and length of a line to be treated, the nature and configuration of the pig being used, the condition of the line being cleaned or treated, and the like. Pumping capacities of about 250 to 1250 gpm, typically about 500 to 1,000 gpm, are generally suitable for purposes of the invention, although other capacity pumps may be suitable or desirable depending on the overall operating conditions pertaining to a given pigging application.

The invention provides a genuine benefit in the art of in-situ pigging applications. By enabling a pump system to be switched between parallel and series operation to achieve desired high flow or high pressure conditions as required in the course of a pigging operation, capital and operating cost savings are achieved, thus enhancing the feasibility of employing the highly desirable and advantageous in-situ pigging approach to the cleaning or conditioning of the inner surface of pipelines and other conduits.

We claim:

1. A pumper system for the introduction of propelling fluid through a line during pigging applications for the in-sire cleaning or conditioning of lines comprising:

(a) first pump means for the pumping of propelling fluid to the line to be cleaned or treated;

(b) second pump means for the pumping of propelling fluid to said line to be cleaned or conditioned;

(c) a discharge line for the passage of the propelling fluid from the second pump means to said line to be cleaned or conditioned;

(d) an inlet line for the introduction of propelling fluid to the first pump means;

(e) conduit means for the passage of propelling fluid from the first pump means to the second pump means;

(f) first by-pass means for passing propelling fluid from the inlet line to the second pump means without passage to the first pump means;

(g) valve control means to enable the passage of propelling fluid from said first by-pass means to said second pump means, and to preclude the passage of propelling fluid in said conduit means from the first pump means to the second pump means, for higher flow, lower pressure parallel operation of said first and second pump means during normal pigging operations, said valve control means precluding the passage of propelling fluid from said first by-pass means to said second pump means, and enabling the passing of propelling fluid in said conduit means for the first pump means to the second pump means, during lower flow, higher pressure series operation of said first and second pump means during periods in which a resistance to pig flow is encountered;

(h) second by-pass means for the passage of propelling fluid between said conduit means and said discharge line;

(i) valve means positioned in the second by-pass means to permit the passage of propelling fluid from said conduit means to said discharge line at a lower pressure during parallel operation of said first and second pump means, said valve means precluding the back flow of propelling fluid in said second by-pass means at an upper pressure during series operation of said first and second pump means, whereby said first and second pump means can be switched between the higher flow, lower pressure, parallel operation required to provide propelling fluid for the passage of a pig device through the line during normal pigging operations, and the lower flow, high pressure, series operation required to provide propelling fluid to overcome the occasional resistance to the movement of the pig device occasionally encountered in the course of pigging operations.

2. The pumper system of claim 1 in which said valve control means comprises a two-way control valve.

3. The pumper system of claim 1 in which the valve means positioned in said second by-pass means comprises a check valve.

4. The pumper system of claim 1 in which said first pump means and said second pump means comprise centrifugal pumps.

5. The pumper system of claim 2 in which the valve means positioned in said second by-pass means comprises a check valve.

6. The pumper system of claim 1 and including: (a) third pump means for the pumping of propelling fluid to said line to be cleaned or conditioned; (b) a discharge conduit for the passage of propelling fluid from said third pump means to said line to be cleaned or conditioned; (c) third by-pass means for the passage of propelling fluid between said discharge line from said second pump means and said discharge conduit, said discharge line passing propelling fluid from said second pump means to said third pump means, and (d) second valve means positioned in the third by-pass means to permit the passage of propelling fluid from said discharge line to said discharge conduit at a lower pressure level, said second valve means precluding the back flow of propelling fluid in said third by-pass means at an upper pressure level.

7. The pumper system of claim 6 in which said valve control means comprises a two-way control valve.

8. The pumper system of claim 7 in which said valve means and said second means comprise check valves.

9. The pumper system of claim 8 in which said first, second and third pump means comprise centrifugal pumps.

* * * * *

UNITED STATES PATENT AND TRADEMARK OFFICE

CERTIFICATE OF CORRECTION

PATENT NO. : 5,431,545

DATED : July 11, 1995

INVENTOR(S) : L. F. Knight et al.

It is certified that error appears in the above-identified patent and that said Letters Patent is hereby corrected as shown below:

Column 5,

Claim 1, line 3 thereof, change "in-sire" to ---in-situ---.

Signed and Sealed this

Seventh Day of November, 1995

*Attest:*

*Attesting Officer*

BRUCE LEHMAN

*Commissioner of Patents and Trademarks*